United States Patent [19]

Gannaway

[11] 4,115,044

[45] Sep. 19, 1978

[54] VALVE ARRANGEMENT FOR COMPRESSOR

[75] Inventor: Edwin L. Gannaway, Adrian, Mich.

[73] Assignee: Tecumseh Products Company, Tecumseh, Mich.

[21] Appl. No.: 729,374

[22] Filed: Oct. 4, 1976

[51] Int. Cl.[2] ..... F04B 39/10

[52] U.S. Cl. ..... 417/564

[58] Field of Search ..... 417/562, 563, 564, 571, 417/559; 137/516.21, 516.15

[56] References Cited

U.S. PATENT DOCUMENTS

| | | | |
|---|---|---|---|
| 1,563,144 | 11/1925 | Baker | 417/564 |
| 2,562,954 | 8/1951 | Schmidlin | 417/571 |
| 3,292,848 | 12/1966 | Kehler | 417/564 |
| 3,360,006 | 12/1967 | Kehler | 137/516.21 |
| 3,689,199 | 9/1972 | Bassinger | 417/564 |
| 3,786,834 | 1/1974 | Garland | 417/564 |
| 3,829,253 | 8/1974 | Bunn | 417/564 |
| 3,945,397 | 3/1976 | Riedel | 137/516.21 |
| 3,986,798 | 10/1976 | Lindell | 417/564 |

*Primary Examiner*—William L. Freeh

*Attorney, Agent, or Firm*—Albert L. Jeffers; John F. Hoffman

[57] ABSTRACT

A valve arrangement for a compressor, particularly a compressor for compressing refrigerant, in which a compressor is provided with ports distributed circumferentially about the axis of the piston and cylinder of the compressor and with a valve member in the form of a ring adjacent the ports for controlling the ports. Associated with the valve ring is a spring in the form of a wave washer urging the ring toward the valve ports. The ring forming the movable member of the valving arrangement and the wave washer serving as a spring require the minimum in space and have long life because the fatigue factor in respect of both is quite small.

3 Claims, 3 Drawing Figures

VALVE ARRANGEMENT FOR COMPRESSOR

The present invention relates to compressors, especially compressors for compressing refrigerant, and is particularly concerned with a valve arrangement for compressors of the nature referred to.

Compressors of various types, including compressors for refrigerant, are known and quite often take the form of a cylinder-piston arrangement in which reciprocation of the piston is operable for drawing the fluid to be compressed into the cylinder and for then expelling the fluid therefrom. The best conditions are established in a device of this nature when the volume confined within the closed end of the cylinder is at a minimum when the piston is in fully advanced position.

Since the inlet valve arrangement for a compressor must open inwardly into the cylinder, a valve plate or plates is usually provided at the piston end of the inlet port means. If such a valve plate or plates is provided with coil springs urging the plate or plates toward port closing position, a substantial volume must be provided for the springs, such as axial bores in the cylinder wall, and these detract from the efficiency of operation of the compressor.

The primary object of the present invention is the provision of a valve arrangement for compressors of the nature referred to which provides for long life of the movable valve plate while improving the efficiency of the compressor.

Compressors of the nature referred to quite often operate at high pressures and, especially when pumping refrigerants, it sometimes occurs that at least a part of the pumped out fluid will be in liquid form and high peak pressures can be established on the fluid as the piston approaches its fully advanced position. Under these circumstances, it becomes possible to encounter gasket failure and such an occurrence would, of course, interfere with the operation of the compressor and require correction.

Accordingly, it is a further object of the present invention to provide a compressor arrangement in which difficulties previously encountered, like gasket failures, are eliminated.

BRIEF SUMMARY OF THE INVENTION

According to the present invention, a compressor is provided having a cylinder block, with a cylinder bore therein, in which a piston is reciprocable. One end of the cylinder bore is closed by a flat valve plate, and in fully advanced position, the piston is closely adjacent the valve plate.

The valve plate has inlet ports extending therethrough with ends opening into the cylinder bore near the periphery thereof with opposing ends opening to the side of the valve plate facing away from the cylinder block. The plate also includes outlet ports extending therethrough in circumferentially distributed relation and located radially inwardly from the inlet ports.

A cylinder head is mounted on the side of the valve plate facing away from the cylinder block and includes channels communicating with the aforementioned inlet and outlet ports and separated by a rib extending toward the valve plate. A gasket between the valve plate and head seals between the passages and bolt means connect the head to the cylinder block.

A valve member for controlling the outlet ports is provided and takes the form of a ring resting on the side of the valve plate facing away from the cylinder bore. An abutment member is provided resting on the same said side of the valve plate and having a peripheral undercut on the side facing the valve plate and in which undercut the aforementioned ring for controlling the outlet ports is disposed. Spring means, which may be in the form of a wave washer, continuously urges the ring toward the outlet ports.

A valve member which is also in the form of a ring is provided at the cylinder block ends of the inlet ports. This last mentioned ring is a single ring member that controls all of the inlet ports. The ring is partly disposed inside the radially outer limits of the cylinder bore and partly radially outside the said limits.

The end of the cylinder block is counterbored to accomodate that portion of the inlet valve ring disposed therein while the end of the piston facing the valve plate has a peripheral undercut for accommodating the ring which controls the inlet ports thereby permitting the piston to advance to a position extremely close to the valve plate.

According to the present invention, the ring controlling the inlet ports is urged toward the inlet ports by a wave washer accommodated in the central counterbore underneath the inlet port controlling ring and is disposed entirely outside the radial limits of the cylinder bore.

The ring previously referred to on the side of the valve plate facing away from the cylinder and overlying the outer ends of the outlet ports may also be backed up by a wave washer. An abutment member is provided backing up to the wave washer and engages the center of the valve plate. A central bolt is provided extending through the valve plate and the abutment member and the head and having a head on the side of the valve plate facing the cylinder bore while nuts are threaded onto the bolt on the side of the abutment member facing away from the valve plate and also on the outer side of the head. Both the valve plate and the outer end of the cylinder may have recesses to receive the head of the central bolt.

The central bolt means interconnecting the cylinder head, the abutment member and the valve plate prevent deflection of the head and valve plate members and substantially eliminate the failure of gasket material placed between the head and the valve plate and between the valve plate and the aforementioned rib. Other gasket material is provided between the valve plate and the end of the cylinder block.

The exact nature of the present invention will become more clearly apparent upon reference to the following detailed specification taken in connection with the accompanying drawings in which.

DETAILED DESCRIPTION OF THE INVENTION

Figure 1:
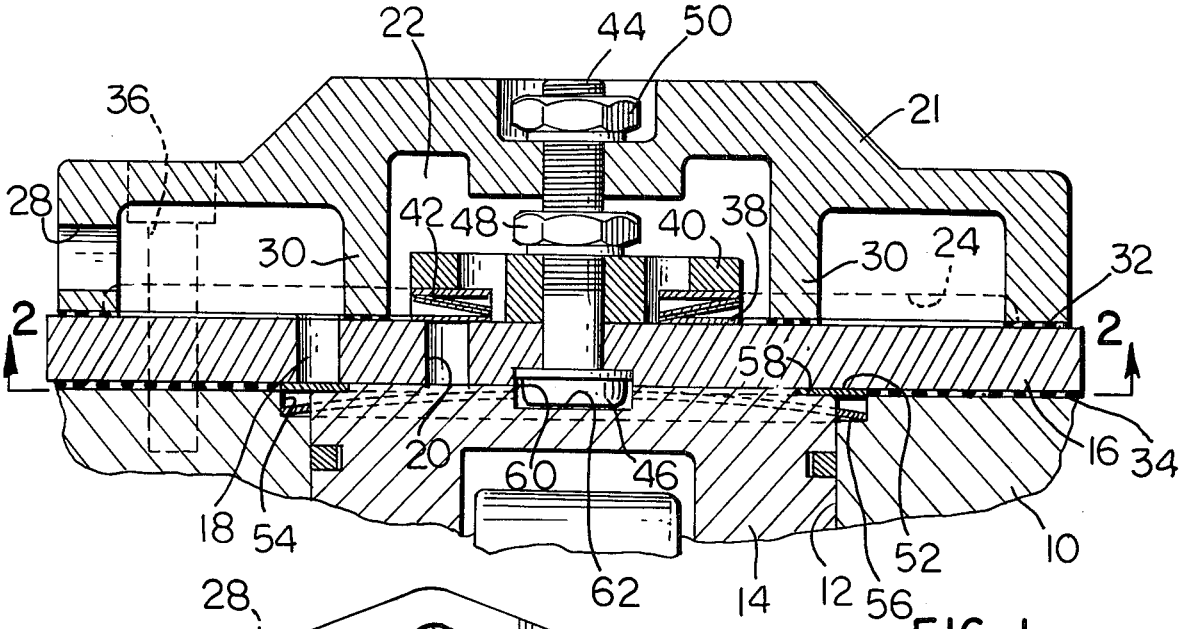
FIG. 1 is a fragmentary sectional view showing the upper end of a cylinder block having a cylinder bore and piston therein with a valve plate closing the end of the cylinder bore and a head mounted on the cylinder block and confining the valve plate thereto.

Referring to the drawings somewhat more in detail, in FIG. 1, reference numeral 10 indicates a cylinder block having a cylinder bore 12 therein. A piston 14 is reciprocably mounted in cylinder bore 12.

A relatively thin valve plate 16 closes the upper end of cylinder bore 12 and is provided with circumferentially distributed inlet ports 18 near the outer periphery of the cylinder bore and circumferentially distributed outlet ports 20 located radially inwardly from inlet ports 18.

Figure 2:
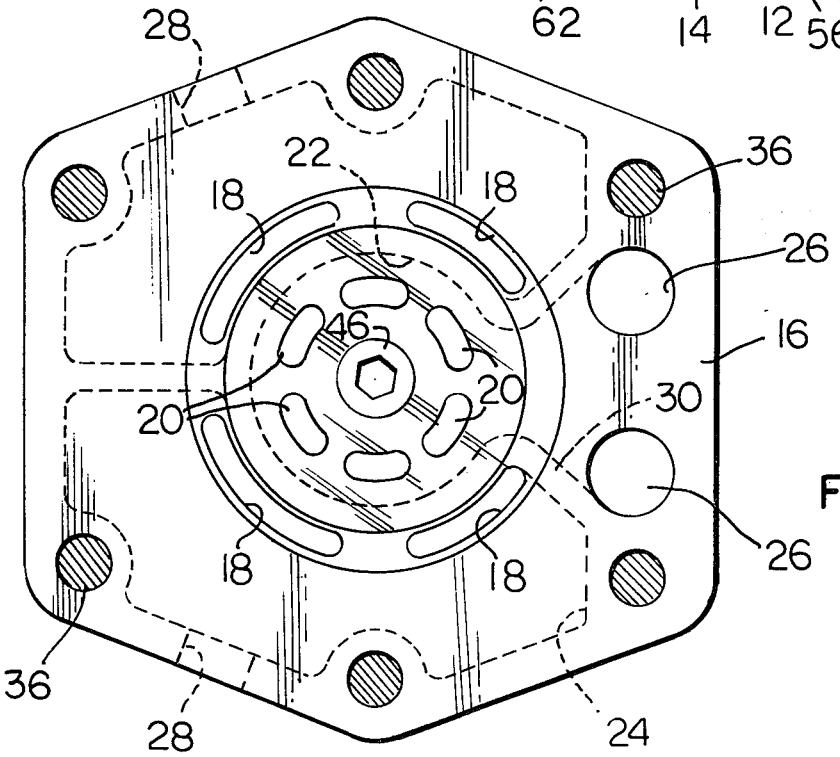
FIG. 2 is a section indicated by line 2—2 on FIG. 1.

As will be seen in FIG. 2, the inlet and outlet ports are in the form of arcuate slots disposed concentrically around the central axis of the piston and cylinder bore.

A head member 21 is mounted on the side of valve plate 16 which faces away from cylinder block 10 and is provided internally with first channel or chamber means 22 above valve plate 16 and communicating with that region of the valve plate and to which outlet ports 20 open and with further channel or chamber means 24 communicating with the top of valve plate 16 in that region where inlet ports 18 communicate with the top of the valve plate.

As will be seen in FIG. 2, the chamber 22, through which fluid is discharged from the discharge ports 20, communicates with ports 26 which may be connected to any suitable conduit means.

The chamber means 24 for supplying the inlet ends of the inlet ports 18 communicate with suitable inlet port means such as those indicated in dotted outline at 28 in FIG. 2.

FIG. 2 will show that the chambers 22 and 24 are isolated from one another by rib means 30 formed on the head and engaging the upper side of valve plate 16 in the region thereof disposed radially between inlet ports 18 and outlet ports 20.

Gasket material 32 is provided which is interposed between the head 21 and valve plate 16 and further gasket material may also be provided at 34 between the valve plate and the outer end of the cylinder block 10.

Bolt means 36 are provided extending through the head and valve plate and into the cylinder block 10 thus clamping the head to the cylinder block and holding the gasket material between the head and the valve plate and between the valve plate and the cylinder block in compressed condition.

The outlet ports 20 at the axially outer ends thereof are under the control of a ring-like valve member 38 which is disposed in a downwardly facing annular undercut formed in the end of an abutment member 40 disposed beneath head 21. Spring means 42, which may be in the form of a wave washer, biases plate 38 toward the outer ends of outlet ports 20.

A central bolt 44 is provided having a head 46 on the underneath side of valve plate 16 and extending axially through abutment member 40 and head 21 and having nut 48 thereon engaging the upper side of abutment member 40 and nut 50 thereon engaging the top of head 21.

The provision of bolt 46 and nuts 48 and 50 provides for preventing the central part of the head from deflecting outwardly and the valve plate from deflecting inwardly under pressure differentials and thereby assists in preventing any gasket failure and which could occur in the event of liquid slugging during operation of the compressor. The provision of the central coaxial bolt 46 permits the use of a thin valve plate 16 so as to minimize re-expansion volume in the discharge port.

A particularly important feature of the present invention is to be found in the provision of a ring-like valve member 52 mounted in controlling relation to the lower ends of inlet ports 18. Ring 52, it will be noted, is disposed partly outside the radially outer limits of bore 12 and partly within said limits. The cylinder bore is provided with a counterbore 54 for accommodating the outer marginal portion of ring 52 and located entirely within counterbore 54 is a wave washer 56 which continuously biases ring 52 toward the lower ends of inlet ports 18.

The piston 14 is advantageously provided with a peripheral undercut 58 on the upper end for accommodating ring 52 and the piston is in its fully advanced position, as shown in FIG. 1, thereby preventing damage to the ring while permitting clearance between the fully advanced piston and the valve plate to be held to an absolute minimum.

The underside of the valve plate may have a recess 60 to accommodate the head 46 of central bolt 44.

Figure 3:
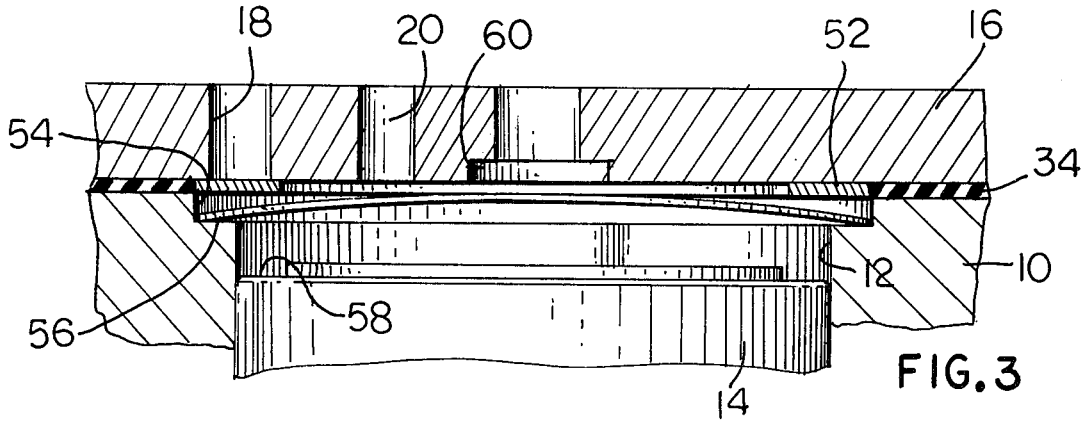
FIG. 3 is a view looking in at the ring which controls the inlet ports of the valve plate showing the relationship of the adjacent wave washer to the ring.

The relationship between wave washer 56 and valve port control ring 52 will be seen in FIG. 3 wherein it will be seen that the wave washer may have as few as two rises therein engaging the underside of ring 52. It will be understood that the wave washer could have more points of engagement with ring 52 if so desired.

The arrangement of the present invention provides for efficient operation because of the extremely small amount of space confined between the valve plate and the piston in fully advanced position of the latter.

Further, the valve rings, especially the ring 52 and the biasing spring therefor are compact and have long life and do not require the creation of a large volume of empty space within the arrangement as would be the case if the valve ring were to be biased by coil springs rather than by the wave washer illustrated.

Still further, the arrangement for bolting the head onto the cylinder block and for connecting the valve plate and abutment member to the head substantially eliminates gasket failure due to liquid slugging during operation of the compressor.

Modifications may be made within the scope of the appended claims.

What is claimed is:

1. A compressor comprising: a cylinder block having a cylinder bore therein, a valve plate having one side the major portion of which is a substantially flat planar surface, said valve plate one side overlying said block and closing one end of said cylinder bore, said block being counterbored concentrically with said cylinder bore at the closed end thereof, a piston reciprocably received in said cylinder bore, inlet ports in said valve plate distributed in a circumferential ring about the axis of said cylinder bore, said inlet ports at least partially overlying said counterbore, valve means for controlling said inlet ports comprising a valve ring having a first side overlying said valve plate and said inlet ports from within said cylinder bore and a second side opposite said first side facing away from said inlet ports, said valve ring extending at least partially into said counterbore, spring means in the form of a wave washer resiliently biasing said valve ring against said valve plate flat surface into closing relationship with said inlet ports, said wave washer being received in said counterbore and resiliently contacting said valve ring at a plurality of points directly opposite said ring of inlet ports, a plurality of outlet ports formed in said valve plate in circumferentially distributed relation radially inward from said inlet ports, valve means on the side of said valve plate which faces away from said cylinder bore for controlling said outlet ports, a head mounted on the side of said valve plate which faces away from said cylinder bore and having first channel means communicating with said inlet ports and second channel means communicating with said outlet ports and rib means between and supporting said channel means, gasket means between said head and said valve plate, a bolt connecting said head to said cylinder block, and bolt means disposed substantially coaxially with said cylinder bore for rigidly connecting said head and said valve plate.

2. The compressor of claim 1 including an abutment member engaging the center of the side of said valve plate which faces away from said cylinder bore and having a peripheral undercut on the valve plate side for receiving the valve means which control said outlet ports, said bolt means extending axially through said valve plate, said abutment member and said head, said bolt means having a head thereon on the piston side of said valve plate and nuts threaded thereon on the sides of said abutment member and head which face away from said piston.

3. The compressor of claim 2 including gasket means between said head and said valve plate and between said valve plate and said cylinder block.

* * * * *